United States Patent [19]

Rosenberg et al.

[11] Patent Number: 4,718,675

[45] Date of Patent: Jan. 12, 1988

[54] DIET GAME

[76] Inventors: Arnold Rosenberg; Norma H. Rosenberg, both of 5323 Cobalt Ct., Cape Coral, Fla. 33904

[21] Appl. No.: 722,513

[22] Filed: Apr. 12, 1985

[51] Int. Cl.[4] ..... A63F 3/00

[52] U.S. Cl. ..... 273/243

[58] Field of Search ..... 273/243, 256, 242, 248, 273/249; 434/127

[56] References Cited

U.S. PATENT DOCUMENTS

| | | | |
|---|---|---|---|
| 3,681,857 | 9/1970 | Yardley | 35/1 |
| 4,310,316 | 1/1982 | Thomann | 434/127 |
| 4,398,721 | 8/1983 | McKay | 273/249 |
| 4,440,396 | 5/1984 | Frudakis | 273/242 |
| 4,460,179 | 7/1984 | Hafer | 273/402 |

*Primary Examiner*—Richard C. Pinkham
*Assistant Examiner*—Matthew L.. Schneider
*Attorney, Agent, or Firm*—Charles E. Temko

[57] ABSTRACT

A game of chance in which the object of each player is to gain the least amount of weight. Each player is given a menu containing six pages of daily activities, each activity having twenty-four numbered choices. These choices have a listing of foods and/or activities which assign plus or minus calories. Serial chance selections are made by the players which designate one of the numbered choices, thereby containing a calorie value for each activity. As each player gains a predetermined weight value, he is eliminated, and the winner of the game is the longest remaining player.

1 Claim, 8 Drawing Figures

MORNING

10

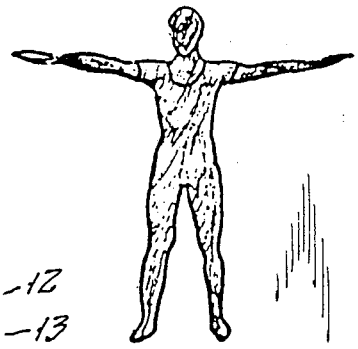

13 11

| | | |
|---|---|---|
| 1 Large Glass Skim Milk | | 80 |
| 2 Med. Fig Bars | | 80 |
| Calories | Plus | 160 12 |
| Week's Value | Plus | 1120 13 |

14 11

| | |
|---|---|
| 1 Glass Whole Milk | 170 |
| 2 Sugar Doughnuts | 400 |
| total Calories | 570 12 |
| Week's Value | 13 3990 |

15

| | |
|---|---|
| 1 Lg. Whole Orange | 100 |
| Total Calories | 100 |
| Week's Value | 700 |

16

| | |
|---|---|
| 1 C. Tea | 5 |
| 1 Tsp. Sugar | 15 |
| 3 Walnuts | 50 |
| 1½ Tblsp. Raisins | 50 |
| Total Calories | 120 |
| Week's Value | 840 |

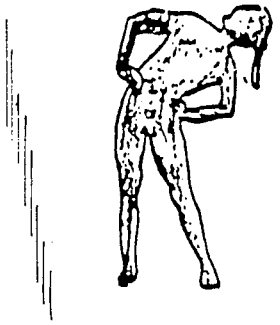

17

| | | |
|---|---|---|
| 1 Hour Jogging | Minus | 500 |
| 1 C. Hot Chocolate | | 200 |
| 2 Cup Cakes | | 300 |
| Calories | | 0 |
| Week's Value | | 0 |

18

| | | |
|---|---|---|
| 1 Hour Jogging | Minus | 500 |
| 1 C. Hot Chocolate | | 200 |
| 1 Danish Pastry | | 250 |
| Calories | Minus | 50 |
| Week's Value | Minus | 350 |
| Penalty: Week's Value | Plus | 3150 |

19

| | | |
|---|---|---|
| 1 Hour Bicycle Riding | Minus | 400 |
| 2 Doughnuts | | 400 |
| 1 C. Coffee with Sugar & Cream | | 70 |
| Calories | Minus | 70 |
| Week's Value | Minus | 490 |

20

| | | |
|---|---|---|
| 1 Hour Reading Book | Minus | 175 |
| 1 C. Coffee with Sugar & Lt. Cream | | 70 |
| 2 Doughnuts | | 400 |
| Calories | Plus | 295 |
| Week's Value | Plus | 2065 |

21

| | | |
|---|---|---|
| 1 Hour Bicycle Riding | Minus | 400 |
| 1 Banana | | 100 |
| 1 Glass Milk | | 170 |
| Calories | Minus | 130 |
| Week's Value | Minus | 910 |

22

| | |
|---|---|
| 2 Slices Plain Cake | 400 |
| 1 C. Hot Chocolate with Milk | 200 |
| Total Calories | 600 |
| Week's Value | 4200 |

23

| | | |
|---|---|---|
| 1 Hour Walk | Minus | 250 |
| 1 Chocolate Candy Bar | | 300 |
| Calories | Plus | 50 |
| Week's Value | Plus | 350 |

24

| | | |
|---|---|---|
| 1 Hour Walk | | 250 |
| 1 C. Coffee with Sugar & Cream | | 70 |
| 1 Danish Pastry | | 250 |
| Calories | Plus | 70 |
| Week's Value | Plus | 490 |

FIG. 1a.

FIG. 2.

20

21

| | | |
|---|---|---|
| 20000 | SCORING SCALE | |
| 19000 | | 95 |
| 18000 | | 90 |
| 17000 | | 85 |
| 16000 | | 80 |
| 15000 | | 75 |
| 14000 | | 70 |
| 13000 | | 65 |
| 12000 | | 60 |
| 11000 | | 55 |
| 10000 | | 50 |
| 9000 | 900 | 45 |
| 8000 | 800 | 40 |
| 7000 | 700 | 35 |
| 6000 | 600 | 30 |
| 5000 | 500 | 25 |
| 4000 | 400 | 20 |
| 3000 | 300 | 15 |
| 2000 | 200 | 10 |
| 1000 | 100 | 5 |

21

DIET GAME

BACKGROUND OF THE INVENTION

This invention relates generally to the field of games of chance to be played by a plurality of players, and more particularly toward a diet oriented motif, in which random value selections determine the number of calories eaten during each of a plurality of eating activities. Acquired calories are added, and a predetermined number of calories determines a sufficient addition of weight to eliminate an individual player.

Various Parchesi-type games including a playing board have been employed for this purpose in the prior art. In such games, playing pieces are advanced to various squares for the acquisition of plus or minus values which will affect total score. In such games, it is the movement of the pieces which determines such score value acquisition.

SUMMARY OF THE INVENTION

Briefly stated, the invention contemplates the provision of an improved game, the motif of which is weight control. Each player is given a menu containing pages of daily activities. Each activity has twenty-four numbered choices. These choices have a listing of foods and/or activities which assign plus or minus calories. For convenience, the values may be multiplied by seven to represent a "week's value" for that activity, bonus, or penalty.

The game also contains a deck of 66 cards, 48 of which are numbered one to twenty-four to correspond to the numbers on the menu. There are also special cards, such as "Will power", cards (wild cards), "You are invited to eat at your neighbor's house" cards, "You didn't exercise-take snack only", etc. Each special card gives instructions for play.

Additionally, four numbered human male and female drawings as a set are given to each player, each successive numbered figure representing a five pound gain in weight.

There is an additional deck of cards called the "Savwah" deck which is placed at the center of the table which may contain any desired number of cards.

A scoring scale and a set of four colored and two black tokens are supplied for each player. One player may be designated as score keeper, and is provided with a calculator and a scoring pad.

BRIEF DESCRIPTION OF THE DRAWINGS

In the drawings, to which reference will be made in the specification, similar reference characters have been employed to designate corresponding parts throughout the several views.

FIG. 1*a* is illustrative of a typical breakfast menu representing one of the single day eating activities used in conjunction with playing the game.

FIG. 2 is a view in elevation of a scoring card issued to each player.

DETAILED DESCRIPTION OF THE DISCLOSED EMBODIMENT

Figure 3:
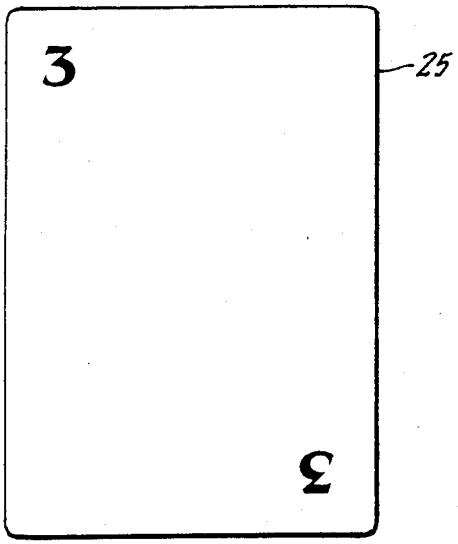
FIG. 3 is a representation of a numbered playing card related to items on the menu shown in FIG. 1*a*.

With reference to the accompanying drawings, reference character 10 indicates a typical menu issued to each player. Most suitably, a plurality of eating activities, such as breakfast, mid-morning snack, lunch, mid-afternoon snack, dinner, and evening snack are incorporated in a single binding (not shown). Each activity menu section includes a plurality of numbered choices 11, indicating a total calorie value 12, and a week's value 13, obtained by multiplying the total calorie value by seven. In some cases, a negative value or credit 14 is indicated, as are penalty values 15 which are applied upon the selection by an individual player of a corresponding playing card.

FIG. 2 illustrates a scoring card 20 issued to each player having values 21 thereon ranging from 5,000 to 20,000 calories, the total score to each player being indicated by one or more tokens 22.

Figure 4:
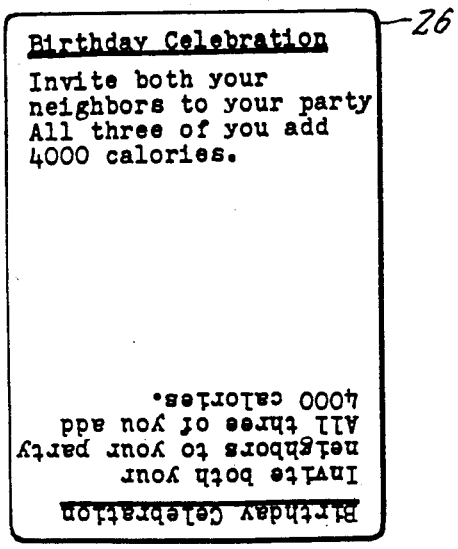
FIG. 4 is a view in elevation of a penalty card normally placed in the same deck with the cards of the type shown in FIG. 3.
Figure 6:
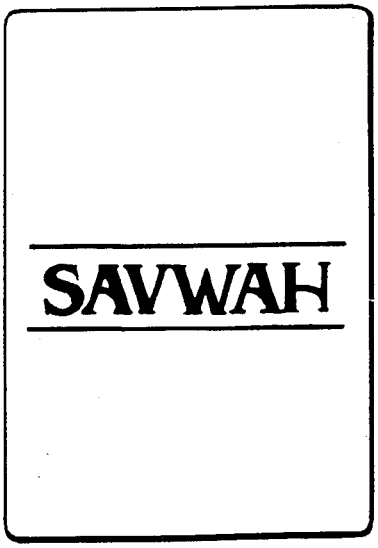
FIG. 6 is a view in elevation of the card shown in FIG. 5, showing the opposite surface thereof.

FIG. 3 illustrates a typical dealer card 25 which will have a single numeral corresponding to the numbered choices 11 on the menu. Interspersed in the dealer deck are a plurality of penalty cards 26 (see FIG. 4) related to the penalty values 15 on menu 10.

Figure 5:
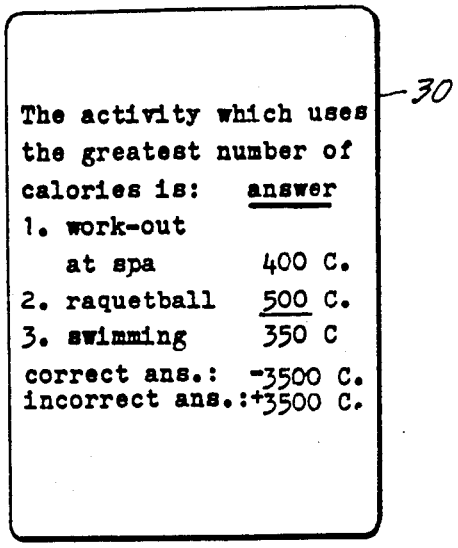
FIG. 5 is a view in elevation of a representative card from the Savwah deck from which individual player selections ae made.

In addition to the dealer cards 25, there is provided a separate deck from which individual selections are made, as will more fully appear hereinbelow, a representative card 30 being illustrated in FIG. 5. Each of these cards has instructions which are followed by the player selecting the card from the top of the deck.

RULES OF PLAY

Figure 7:
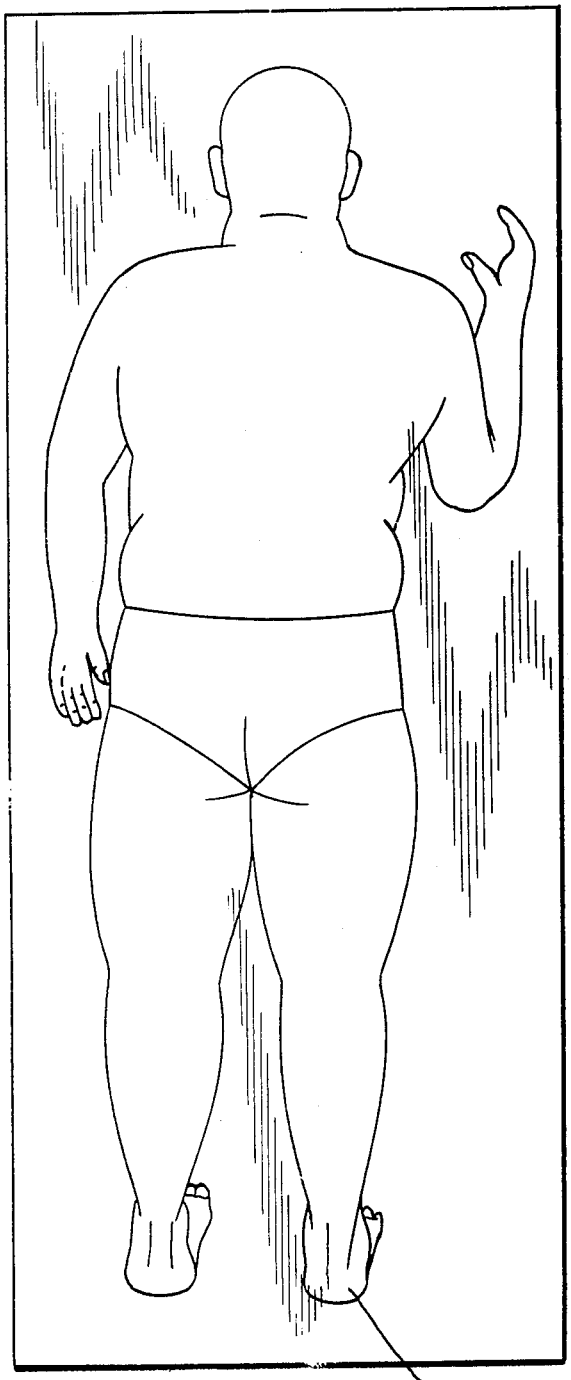
FIG. 7 is a view in elevation showing a card depicting a male figure used in connection with the playing of the game.
Figure 8:
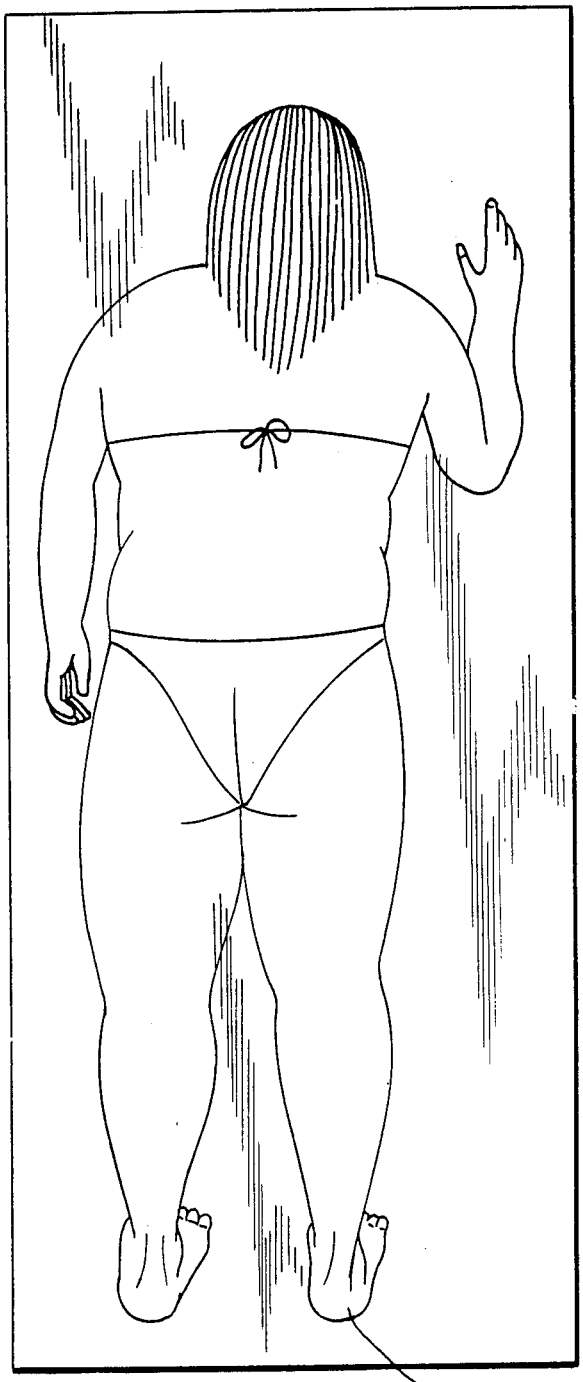
FIG. 8 is a similar card depicting a female figure used in connection with the playing of the game.

With the commencement of the game, each player obtains a single menu, a set of male-female FIGS. 35 and 36 (see FIGS. 7 and 8), a set of four colored and two black tokens 22, and a scoring card 20. A score keeper is chosen from among the players, and is provided with a calculator and a score pad (not shown).

The game is commenced by selecting a dealer who shuffles the cards 25, conveniently referred to as the "avwah dupwah" deck, and deals ten cards to each player starting to his left. The player on the dealer's left then blindly selects one card from the hand of the player to his left. He places this card in his own hand. A numbered card is then chosen from his own hand to match a numbered section with the least number of calories on his breakfast menu. High caloric menus may be color coded in red, medium caloric menus in yellow, and low caloric menus in green. The special cards 26, as mentioned, have individual playing instructions. Each card as it is used is discarded, face up in front of the player.

If a player selects a penalty card, such as "You are invited to dinner at your neighbor's house" card, he must place this card immediately down for all to see. His neighbor from whom he picked that card then chooses an additional card from his own hand representing the highest number of calories he has available which is then "loaded" on the player who picked the penalty card. When a player has no cards left, his neighbor, who usually picks from him, will play a card from his own hand. A player with no cards who has his neighbor without cards, misses a turn. It may occur that the last card in an individual player's hand is a penalty card. The player then will be unable to "load" additional penalty calories on his neighbor.

Each player, in turn, picks a card from the player on his left and proceeds according to the examples given hereinbelow. When every player has had one turn for breakfast, the menu is turned to "mid-morning", and the above proceeding followed. In this manner, the players proceed through all six eating activities, thereby completing one day. At this point, the dealer picks the top from the previously shuffled "Savwah" deck and poses the question on the card to the person on his left. Rewards and penalties are explained on each card.

Subsequently, each person, in turn, draws a card for the player on his left. The discards are placed face down in the center of a playing table. After all players have had one turn answering from the "Savwah" deck, the play returns to the breakfast portion of the menu. This sequence is followed throughout the game. When all initially dealt cards have been used, the dealer deals an additional ten cards per player, using first the remainder of the deck, and then the reshuffled discards.

SCORING METHOD

Each player will use his tokens 22 to keep his score on the score card 20. The designated score keeper will total scores on the calculator and record them on his scoring pad.

EXAMPLE 1

Player No. 1 selects a card 25 (for breakfast) from his hand and places it on the table in front of him face up. The total calories value for this selection is 260.

The "week's value is 1,820 calories. This value is used for all scoring. In order to record this score, the user places one colored token on the 1,000 value of the scale, one colored token on the 800 scale, and one colored token on the 20 scale to represent 1,820 calories. The score keeper will record each player's score for each round on the score pad.

EXAMPLE 2

In the mid-morning section of the menu, player No. 1 selects a card 25 having number 10 which results in 490 calories being added to the previous score of 1,820 calories. The score keeper should have already placed the previous score of 1,820 (recorded on the scoring pad for player No. 1) into the calculator, for subsequent addition. When the new value 490 becomes known, he enters this number and adds the values for a new total of 2,310 calories. The score keeper enters the new total on the score pad and player No. 1 moves his tokens as in Example No. 1.

EXAMPLE 3

Toward the begining of the game, it is possible to have a minus calorie score. If for breakfast, player No. 2 choses menu No. 11, he will have a score of 210 calories. During mid-morning, he may choose menu No. 21 which results in a minus 910 calories. The score keeper will subtract 210 from 90 which results in minus 700 calories. This is recorded on the score pad, and player No. 2 uses his black token to denote the minus score.

EXAMPLE 4

The attainment of 20,000 calories denotes a gain of five pounds. Player No. 3 has reached a score of 17,820. During the next activity (in this example dinner), player No. 3 selects menu No. 10 with a "week's value" of 8,645. The total becomes 26,465 calories. Player No. 3 has now exceeded 20,000 calories by 6,465 calories. Player No. 3 must now display male or female FIGS. 35 or 36 player No. 1 representing a five pound gain and shows a balance of 6,465 calories on the scoring scale with his tokens. The score keeper records 6,465 calories. A player whose score exceeds 20,000 calories a second time, displays an additional male or female FIGS. 35 or 36 to represent a ten pound gain, etc.

Before play begins, the length of the game may be determined by deciding to terminate it with a game of either 10, 15, or 20 pounds. Any player who gains the weight decided upon is eliminated from the game. Each succeeding player is eliminated in the same manner, and the last remaining player is the winner.

We claim:

1. A diet game for play by a plurality of players comprising: a plurality of individual menus, each containing a plurality of daily eating activities, each activity including individual numbered choices, said choices having listings of food and/or activity which have plus or minus calorie values associated therewith; and a deck of selector cards, some of which are numbered to correspond to the number of individually numbered choices on said menus and others of which indicate particular penalties in terms of calorie value; an additional deck of cards, said additional cards having test material thereon relating to questions to be posed to players affecting individual scores; a plurality of numbered human male and female figures indicating various degrees of obesity, as score indicating means; and numerical scoring means for indicating positive and negative caloric scores.

* * * * *